US007272992B2

(12) United States Patent
Farfalli et al.

(10) Patent No.: US 7,272,992 B2
(45) Date of Patent: Sep. 25, 2007

(54) CORK-SCREW WITH DOUBLE PROPPING LEVER

(76) Inventors: Daniele Farfalli, Viale della Vittoria 77B, I-33085 Maniago (PN) (IT); Gianluigi Fortunato, Via Pasubio 5, I-36051 Creazzo (VI) (IT)

( * ) Notice: Subject to any disclaimer, the term of this patent is extended or adjusted under 35 U.S.C. 154(b) by 0 days.

(21) Appl. No.: 11/486,917

(22) Filed: Jul. 14, 2006

(65) Prior Publication Data

US 2007/0051205 A1 Mar. 8, 2007

Related U.S. Application Data

(63) Continuation of application No. PCT/IT2005/000011, filed on Jan. 12, 2005.

(51) Int. Cl.
*B67B 7/04* (2006.01)

(52) U.S. Cl. ..... 81/3.09; 81/3.29; 81/3.47; 81/3.56

(58) Field of Classification Search ..... 81/3.09, 81/3.35, 3.36, 3.29, 3.39, 3.45, 3.55, 3.47, 81/3.56, 3.48, 3.49; 7/155
See application file for complete search history.

(56) References Cited

U.S. PATENT DOCUMENTS

| | | | | |
|---|---|---|---|---|
| 4,437,359 A | | 3/1984 | Dejoux et al. | 81/3.38 |
| 5,992,269 A | * | 11/1999 | Puig et al. | 81/3.35 |
| 6,176,154 B1 | * | 1/2001 | Brucart Puig et al. | 81/3.47 |
| 6,367,353 B2 | * | 4/2002 | Brucart Puig et al. | 81/3.48 |
| 6,415,689 B2 | * | 7/2002 | Castellani et al. | 81/3.47 |
| 6,732,611 B2 | * | 5/2004 | Miguel | 81/3.29 |
| 2002/0157188 A1 | | 10/2002 | Sannajust | 7/156 |

FOREIGN PATENT DOCUMENTS

| | | |
|---|---|---|
| EP | 1 350 756 | 10/2003 |
| FR | 2 689 115 | 10/1993 |

OTHER PUBLICATIONS

International Search Report, Apr. 18, 2005, 2 Pages.

* cited by examiner

*Primary Examiner*—Jacob K. Ackun, Jr.
(74) *Attorney, Agent, or Firm*—St. Onge Steward Johnston & Reens LLC

(57) ABSTRACT

Cork-screw with double propping lever, with an adjacent extraction cork-screw, in which the double propping lever presents a first base lever hinged which one end to the handle of the tool, and a second extension lever for the propping hinged at the end of said first base lever, whereby said second extension lever for the propping presents two propping support teeth, one support teeth at the end and one support teeth close to its articulation to the print base lever.

2 Claims, 1 Drawing Sheet

CORK-SCREW WITH DOUBLE PROPPING LEVER

CROSS-REFERENCE TO RELATED APPLICATIONS

The present application is a continuation of pending International patent application PCT/IT2005/000011 filed on Jan. 12, 2005 which designates the United States and claims priority from Italian patent application UD2004A000004 filed on Jan. 15, 2004, the content of which is incorporated herein by reference.

FIELD OF THE INVENTION

This invention relates to an improved cork-screw with double propping lever according to the preamble of the main claim.

BACKGROUND OF THE INVENTION

The cork-screw of the present innovation is of the pocket type with switchblade particularly suitable for the extraction of plugs from bottles and for the extraction of crown caps.

Cork-screws of this type are well-known indeed in many forms and configurations, as per FR-A-2689115; U.S. Pat. No. 4,437,359; US-A1-2002/157188; EP-A-1350756.

Among the many configurations the cork-screw FR2689115 is known, with, in the support propping lever for the neck of the bottle, instead of a single propping lever, a lever subdivided in arm (5) and forearm (13), in which in the arm internally a hook (7) is provided for taking away the crown caps and over this a support tooth and bottle neck propping (8) for a first extraction of the plug and, with end pivoting (14), a second extension lever or forearm (13) with a second support tooth for propping for completing the extraction of the plug (15).

This solution is thus particularly advantageous for the extraction, with the help of the screw or corkscrew spiral (3), of caps from bottles also when they are partially extracted by means of the action with the first lever (5) for facilitating the completion of the extraction, precisely by means of the second openable lever (13).

Drawbacks of this earlier solution substantially consist in the impairment of the support tooth (8) because of the appendix (9) that, during extraction comes into contact with the border of the bottle trying to drag outwards the tooth (8). In fact during the extraction, for a vertical exit of the cap, the propping lever must perforce tilt. At the start it is pratically parallel to the spiral, after having extracted about 1 centimeter of the cap it is inclined and therefore the appendix (9) hits the border of the bottle and drags the support tooth (8) outwards. Repeating the operation several times the support tooth (8) blunts and does not guarantee anymore the propping on the border of the bottle.

In fact the difficulty of incipient extraction of the cap is known, due to excessive approach or remoteness of the propping lever (5) from the cork-screw.

In fact it is well known that during the operation of the lever, as the lever handle must unavoidably tilt as to the axis of the bottle, the distance between the propping lever and the extraction lever (cork-screw) varies.

To solve this problem many solutions have been conceived, among which the variation with cam of the pivoting axis of one or the other lever (6) and/or (4).

These solutions however involve a considerable complexity of construction and therefore high realization costs.

Therefore if the second support in the propping lever extension (15) can adjust better in the distance, certainly the first cannot, so the problem of a maximum perfect functionality still remains.

The aim of the present invention is to avoid the above-mentioned drawbacks, realizing a much more versatile and functional pocket cork-screw, however at a reasonable cost.

SUMMARY OF THE INVENTION

The problem is solved with the characteristics of main claim.

The subclaims represent particularly advantageous solutions.

With this solution, thanks to the positioning of both support teeth for propping on the extension lever, the support teeth, in particular no. (33), do not graze anymore on the border of the bottle because of the tilt of the propping lever, but remain fixed and without transverse movements, therefore maintaining their form for a long time without blunting and thus without fastidious hooking losses.

BRIEF DESCRIPTION OF THE DRAWINGS

This invention will be now better understood with the help of the enclosed FIGURE including.

DETAILED DESCRIPTION OF THE INVENTION

Figure 1:
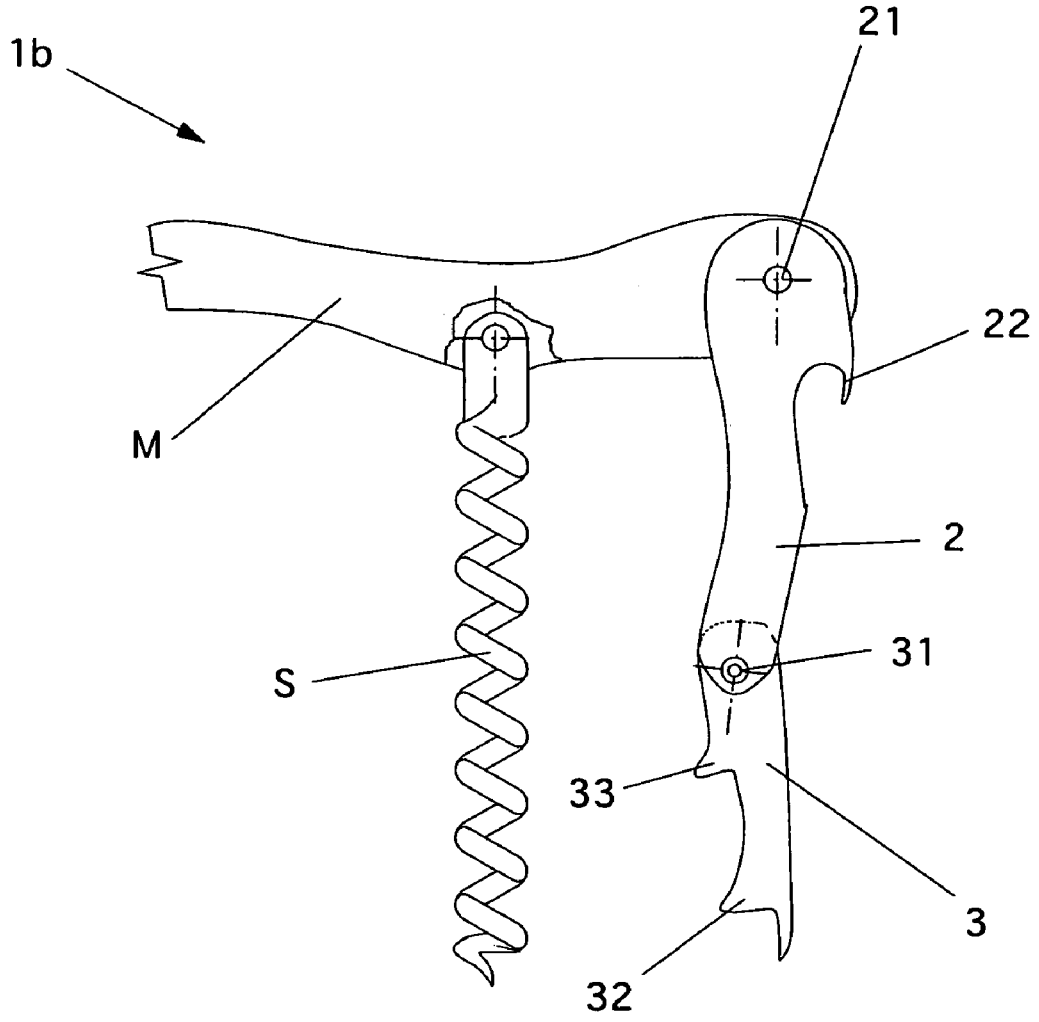
In FIG. 1 the position of the lever extension slightly rotated towards the back and therefore with better propping safety and easier propping for both support teeth and greater variability in selfadjusting of the distance with the cork-screw according to the present invention.

According to the FIGURE it is observed that with (1*b*) the position of the lever extension (3) is indicated slightly refolded to the contrary, namely outwards as to the respective end pivot (31) on the base lever arm (2) which in turn presents the crown caps opening hook (22) placed outside and applied near the pivoting base (21) at the handle (m).

The extraction cork-screw (5) is carried out according to prior art and according to the invention both support teeth for propping (32, 33) are applied internally on the lever extension (3).

In this way a complete self-regulation of the distance between said propping abutments (323,33) with respective lever extension (3) thanks to the articulation (31) in association with the articulation of the base propping lever (21) is obtained.

Naturally the cork-screw is represented here only for the part of the extraction side, the other part can be realised as desired, namely with little knives, with or without other tools etc.

Advantageously inside the handle and between said first propping lever and extension lever traditional cutting means can be provided, e. g. with wheels, for the coating the neck of the bottle according to prior art.

What is claimed is:

1. Cork-screw tool comprising a handle, an extraction cork-screw, and a double propping lever adjacent the extraction cork-screw, the double propping lever comprising a base lever having a first end hinged to the handle and a second end, and an extension lever having a first end hinged to the second end of said base lever, characterised in that said extension lever includes a first propping support tooth at the second end of said extension lever and a second propping support tooth between the first support tooth and the first end of said extension lever, and wherein said base lever includes an outer hook at the first end of said base lever.

2. Cork-screw tool according to claim 1, characterised in that said extension lever is pivotable relative to said base lever more than 180 degrees.

* * * * *

UNITED STATES PATENT AND TRADEMARK OFFICE

CERTIFICATE OF CORRECTION

PATENT NO. : 7,272,992 B2
APPLICATION NO. : 11/486917
DATED : September 25, 2007
INVENTOR(S) : Daniele Farfalli et al.

It is certified that error appears in the above-identified patent and that said Letters Patent is hereby corrected as shown below:

On the title page item (76) Inventors should read:
Daniele Farfalli, Viale della Vittoria 7/B, I-33085 Maniago (PN) (IT);
Gianluigi Fortunato, Via Pasubio 5, I-36051 Creazzo (VI) (IT)

On the title page add the following after item (63),

(30) Foreign Application Priority Data
January 15, 2004 (IT).....UD2004A000004

Signed and Sealed this

Eighth Day of July, 2008

JON W. DUDAS
*Director of the United States Patent and Trademark Office*